US007912400B2

(12) United States Patent
Pickett et al.

(10) Patent No.: US 7,912,400 B2
(45) Date of Patent: Mar. 22, 2011

(54) DEVICES AND METHODS FOR REMOVING TONER FROM A BELT WITHIN AN IMAGE FORMING APPARATUS

(75) Inventors: Peter Brown Pickett, Lexington, KY (US); Jason Martin, Winchester, KY (US); Frank Hughes, Paris, KY (US); Hrishikesh Pramod Gogate, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 781 days.

(21) Appl. No.: 11/856,818

(22) Filed: Sep. 18, 2007

(65) Prior Publication Data

US 2009/0074445 A1 Mar. 19, 2009

(51) Int. Cl.
*G03G 15/16* (2006.01)

(52) U.S. Cl. ..... 399/101

(58) Field of Classification Search ..... 399/101, 399/297, 350, 351, 358
See application file for complete search history.

(56) References Cited

U.S. PATENT DOCUMENTS 4,650,312 A 3/1987 Vineski
4,659,212 A 4/1987 Ichihara et al.
4,685,798 A 8/1987 Matsumoto
4,819,578 A 4/1989 Koiso et al.
4,974,031 A 11/1990 Koiso et al.
4,982,240 A 1/1991 Nakano
5,113,227 A 5/1992 Miyasaka
5,130,756 A 7/1992 Taniyama
5,229,826 A 7/1993 Sonnenberg
5,708,952 A 1/1998 Taniguchi et al.
5,715,502 A 2/1998 Taniguchi et al.
6,014,541 A 1/2000 Kato et al.
6,055,405 A 4/2000 Knott et al.
6,085,062 A 7/2000 Mizuishi et al.
6,266,511 B1 7/2001 Murakami et al.
6,418,297 B1 7/2002 Yamatani et al.
6,459,866 B1 * 10/2002 Meguro ..... 399/350
6,463,254 B1 10/2002 Maul et al.
6,477,351 B1 * 11/2002 Thayer et al. ..... 399/350
6,587,666 B2 * 7/2003 Kato et al. ..... 399/350
6,832,067 B2 12/2004 Kubo
6,968,139 B2 11/2005 Ban et al.
7,043,189 B2 5/2006 Blair et al.
7,558,522 B2 * 7/2009 Ogasawara et al. ..... 399/358
7,676,172 B2 * 3/2010 Budding et al. ..... 399/101

* cited by examiner

*Primary Examiner* — William J Royer

(57) ABSTRACT

The present application is directed to devices and methods for removing toner from a belt within an image forming apparatus. In one embodiment, the device includes a housing that forms an enclosed interior space. The housing may include an inlet that leads into the interior space. A blade may be positioned in proximity to the inlet to remove the toner from the belt and direct it into the inlet. An auger may be rotationally positioned within the interior space to move the toner along a longitudinal width of the device. An agitating member may be rotationally positioned within the interior space to move the toner from the inlet towards the auger. The agitating member may include a flexible arm that contacts against at least one of the blade and the auger during rotation.

20 Claims, 6 Drawing Sheets

DEVICES AND METHODS FOR REMOVING TONER FROM A BELT WITHIN AN IMAGE FORMING APPARATUS

BACKGROUND

The present application is directed to devices and methods for removing toner from a belt within an image forming apparatus.

Image forming apparatuses form and transfer one or more toner images to a media sheet. In a direct transfer system, the toner images are initially formed on a development member and then transferred to a media sheet. In a secondary transfer system, the toner images initially formed on the development member are first transferred to an intermediate member, and then transferred from the intermediate member to the media sheet. The toner images may be transferred to a belt in the various transfer systems. The belt may include but is not limited to a transfer belt that moves the media sheet in the direct transfer system, the intermediate member in the secondary transfer system, and the development member in either system.

Some portion of the one or more of the toner images may not transfer from the belt during the transfer process. This non-transferred toner, referred to as residual toner, should be removed from the belt prior to the next toner image being transferred to the belt. In some prior art devices, a cleaner device is positioned to remove the residual toner from the belt. However, these prior art devices have caused various types of problems.

Many prior art toner removal devices are relatively large. With the size of many image forming apparatuses currently being reduced, the space available for positioning the removal devices is often small. Many current apparatuses include architectures that cannot accommodate a large removal device.

The physical properties of the toner may further complicate removal of the residual toner from the belt. The toner may tend to adhere together forming a mass that is difficult to move away from the belt. The adhered toner also prevents subsequent residual toner from being removed from the belt.

SUMMARY

The present application is directed to devices and methods for removing toner from a belt within an image forming apparatus. In one embodiment, the device includes a housing that forms an enclosed interior space. The housing may include an inlet that leads into the interior space. A blade may be positioned in proximity to the inlet to remove the toner from the belt and direct it into the inlet. An auger may be rotationally positioned within the interior space to move the toner along a longitudinal width of the device. An agitating member may be rotationally positioned within the interior space to move the toner along a depth of the device from the inlet towards the auger. In one embodiment, the agitating member includes a flexible arm that contacts against at least one of the blade and the auger during rotation.

DETAILED DESCRIPTION

The present application is directed to a toner removal device and methods for removing residual toner from a belt within an image forming apparatus. The device may include a housing that forms an enclosed interior space. A blade may be positioned to remove the toner from the belt and direct it into the interior space. An auger may be rotationally positioned within the interior space to move the toner along a longitudinal length of the device. An agitating member may be rotationally positioned within the interior space to move the toner towards the auger. The agitating member may include a flexible arm that contacts against at least one of the blade and the auger during rotation.

Figure 1:
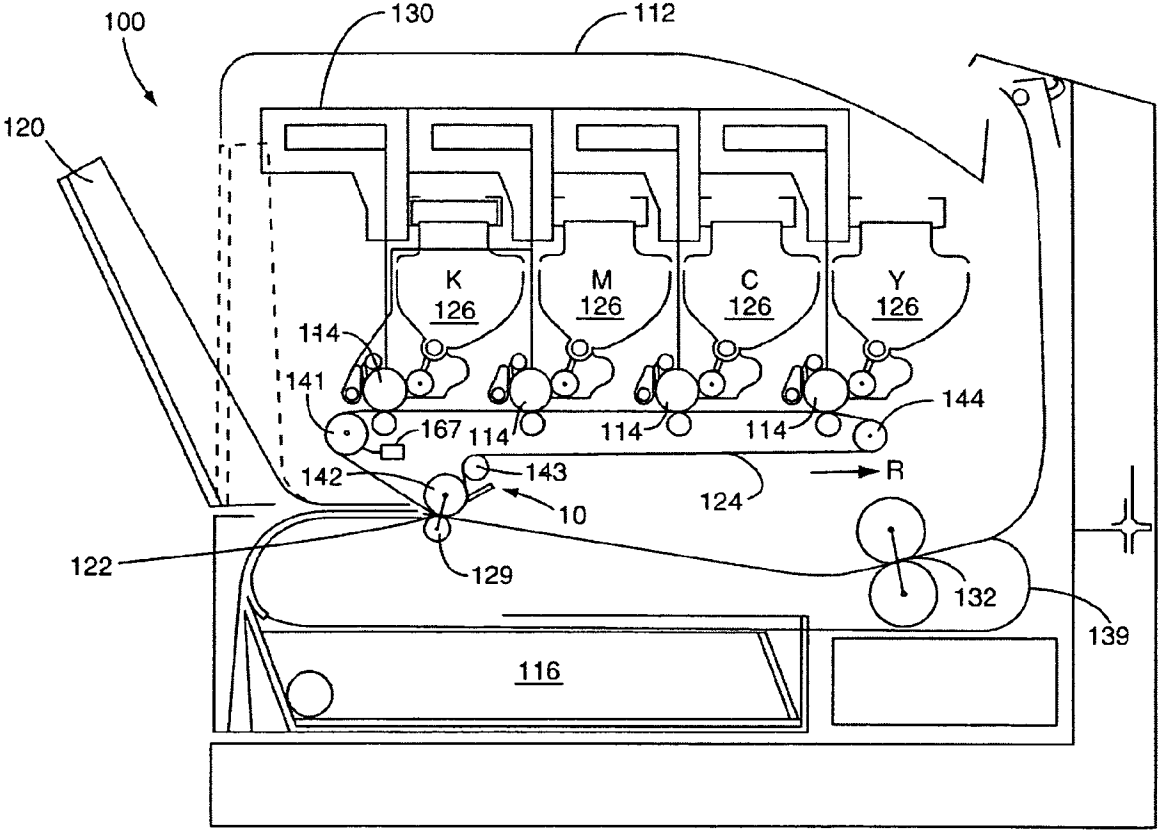
FIG. 1 is a schematic side view of an image forming apparatus according to one embodiment.

FIG. 1 depicts a representative image forming apparatus, indicated generally by the numeral 100. The image forming apparatus 100 includes a printer body 112 with an interior space sized to hold a main media sheet stack 116. Media sheets may also be introduced through a manual input 120. The term "image forming apparatus" and the like is used generally herein as a device that produces images on a media sheet. Examples include but are not limited to a laser printer, ink-jet printer, fax machine, copier, and a multi-functional machine. Examples of an image forming apparatus include Model Nos. C750 and C752 available from Lexmark International, Inc. of Lexington, Ky.

A number of image formation cartridges 126 are positioned within the body 112. In one embodiment, each cartridge 126 may be removed from the body 112 and replaced as necessary. The cartridges 126 may each include a similar construction but are distinguished by the toner color contained therein. In one embodiment, the image forming apparatus 100 includes a black cartridge (K), a magenta cartridge (M), a cyan cartridge (C), and a yellow cartridge (Y). Each cartridge 126 forms an individual monocolor toner image that is combined in layered fashion with toner images from the other cartridges to create the final multi-colored toner image. The image forming apparatus 100 further includes an intermediate transfer mechanism (ITM) belt 124, one or more imaging devices 130, a fuser 132, and a removal device 10 as well as various rollers, actuators, sensors, optics, and electronics (not shown) as are conventionally known in the image forming apparatus arts, and which are not further explicated herein.

The internal components of removable image formation cartridges 126 are not specifically identified in FIG. 1, but are briefly described. Each image formation cartridge 126 is a removable cartridge that may include a reservoir holding a supply of toner, a developer roller for applying toner to develop a latent image on a photoconductive drum, and a photoconductive (PC) drum 114, which may comprise, for example, an aluminum hollow-core drum coated with one or more layers of light-sensitive organic photoconductive materials. The image formation cartridge 126 may additionally include various rollers, paddles, augers and blades, as well known in the art. Note that this description is representative only—various image formation devices may organize these components into a plurality of cartridges.

The operation of the image forming apparatus 100 is conventionally known. Upon command from control electronics, a single media sheet is "picked," or selected, from either the main media sheet stack 116 or the manual input 120. Regardless of its source, the media sheet is transported to a second transfer location 122 to receive a toner image from the ITM belt 124. The ITM belt 124 is endless and rotates in the direction indicated by arrow R around a series of rollers adjacent to the PC drums 114 of the respective image formation cartridges 126. Rolls include a drive roll 141, a backup roll 142, a reverse roll 143, and a tension roll 144. A motor 167 is operatively connected to provide rotational power to the drive roll 141. Toner is deposited from each PC drum 114 as needed to create a full color image on the ITM belt 124. The ITM belt 124 and each PC drum 114 are synchronized so that the toner from each PC drum 114 precisely aligns on the ITM belt 124 during a single pass.

The media sheet may receive an electrostatic charge before contacting the ITM belt 124 at the second transfer location 122 to assist in attracting the toner from the ITM belt 124. The transfer location 122 includes a nip formed between the backup roll 142 and a second transfer roll 129. The sheet and attached toner next travel through a fuser 132 having a pair of rollers and a heating element that heats and fuses the toner to the sheet. The sheet with fused image is then transported out of the printer body 112 for retrieval by a user. Alternatively, the media sheet is moved through a duplex path 139 for image formation on a second side.

The removal device 10 removes the toner that remains on ITM belt 124 after the second transfer location 122. This residual toner should be removed prior to the belt 124 rotating around and receiving new toner images from the PC drums 114 for subsequent image formations.

Figure 2:
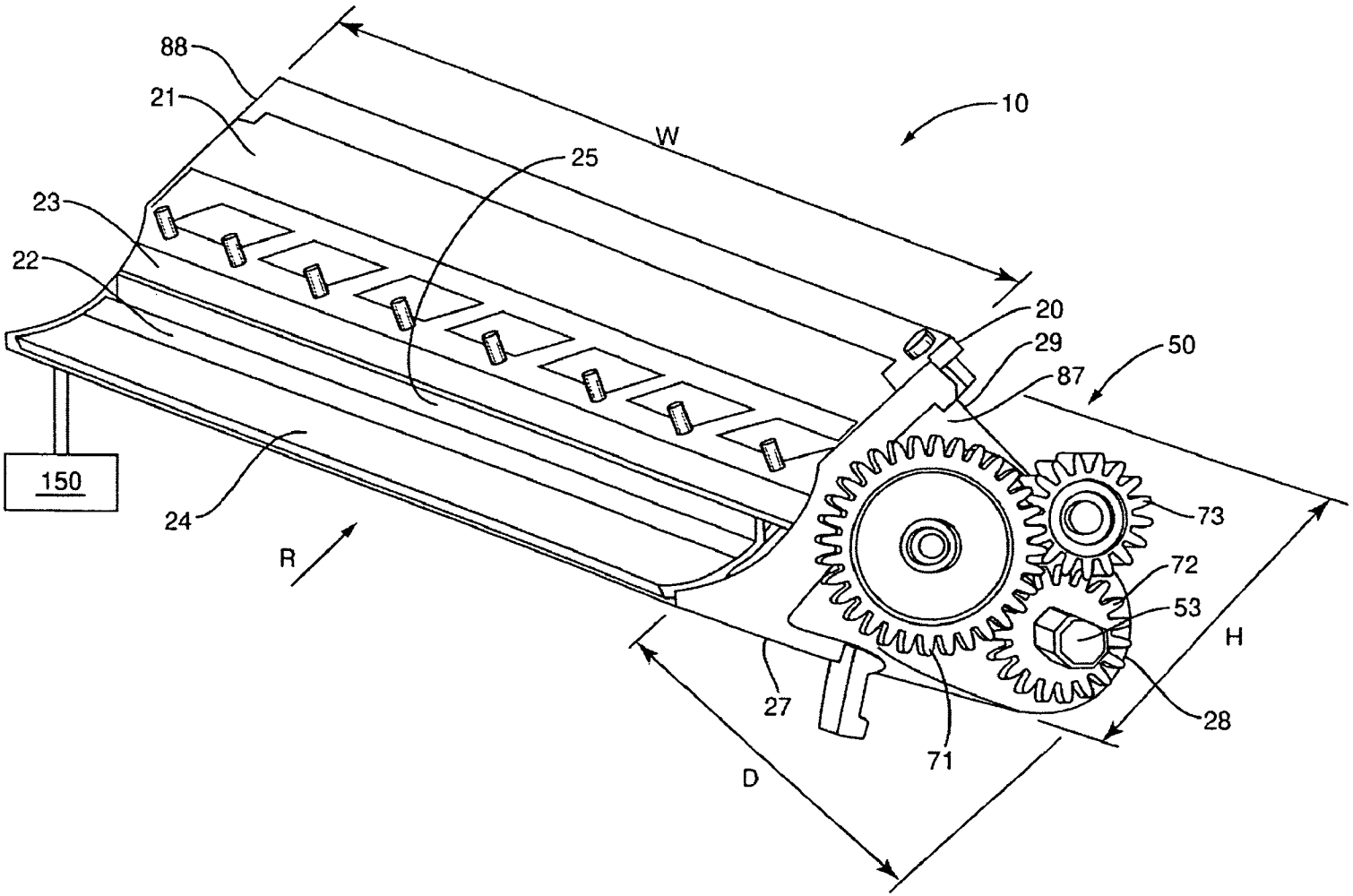
FIG. 2 is a perspective view of a removal device according to one embodiment.

FIG. 2 illustrates a perspective view of the removal device 10. Device 10 includes a housing 20 with a front side 21 that faces towards the ITM belt 124. Front side 21 includes a blade 23 positioned to remove the toner from the ITM belt 124. The device 10 includes a depth D measured between the front side 21 and a back side 28, a height H measured between a floor 27 and a ceiling 29, and a width W measured between first and second ends 87, 88.

An inlet 22 is formed adjacent to the blade 23 to receive the toner and direct it into an interior space 25 formed within the housing 20. A seal 24 is positioned below the inlet 22 to prevent the residual toner from escaping from the inlet 22 and interior space 25. In one embodiment, the width of the removal device 10 is substantially equal to a width of the ITM belt 124.

Figure 3:
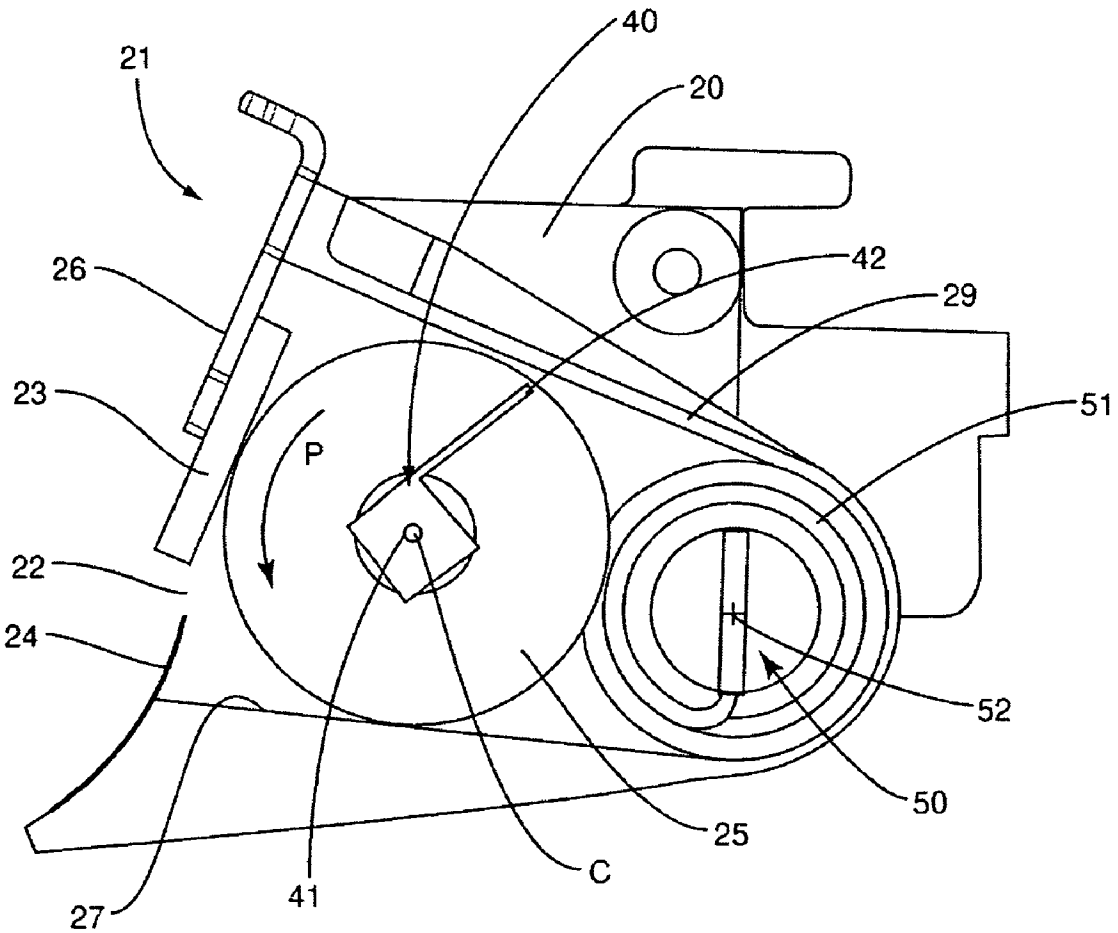
FIG. 3 is a schematic section view of a removal device according to one embodiment.

FIG. 3 illustrates a section view of the housing 20 and the elements within the interior space 25. The front side 21 includes the blade 23 that extends outward to remove the toner from the ITM belt 124. The blade 23 includes a first side that faces outward towards the ITM belt 124, and a second side that faces inward towards the interior space 25. Blade 23 may further include a leading edge that forms an upper extent of the inlet 22. Blade 23 may further be mounted on a bracket 26 that is connected to the housing 20.

The inlet 22 is formed directly below the blade 23 to receive the toner as it is removed from the ITM belt 124. The lower extent of the inlet 22 is formed by the seal 24 that extends upward from a bottom of the housing 20. The height of the inlet 22 measured between the blade 23 and seal 24 may vary, with one embodiment including a height of about 5 mm.

The interior space 25 receives the toner through the inlet 22. The interior space 25 includes the floor 27 that extends between the inlet 22 and an auger 50. The interior space 25 may further include the ceiling 29 spaced vertically upward from the floor 27.

Figure 4:
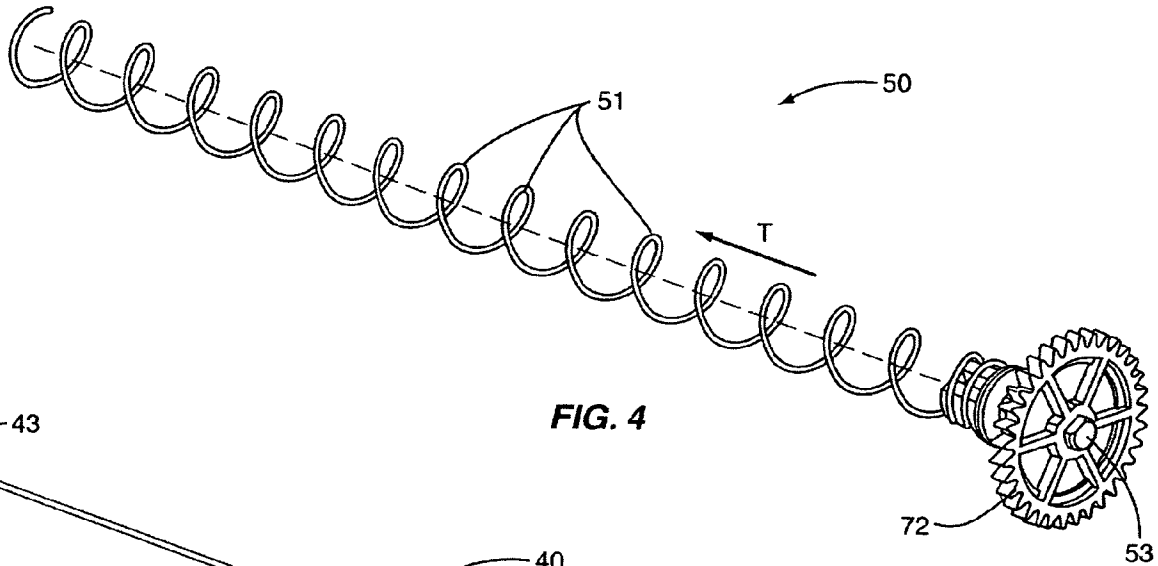
FIG. 4 is a perspective view of an auger with a gear mounted at an end according to one embodiment.

The auger 50 is positioned in the interior space 25 in proximity to the floor 27 and away from the inlet 22. FIG. 4 illustrates one embodiment of the auger 50 that includes a number of helical coils 51. The auger 50 includes an elongated shape and extends along the longitudinal width of the housing 20. Auger 50 may extend the entire length or a limited length of the housing 20. Auger 50 moves the toner longitudinally along the width in the direction indicated by arrow T to a separate part of the housing 20 or a remote storage container 150. In the embodiments shown in the Figures, the auger 50 is depicted as a coiled wire, although other conveyors known to those skilled in the art, including screws or other equivalent devices, may be used. A gear 72 may be attached to an end of the auger 50. Gear 72 may include a shaft 53 with a rotational center point 52.

Figure 5:
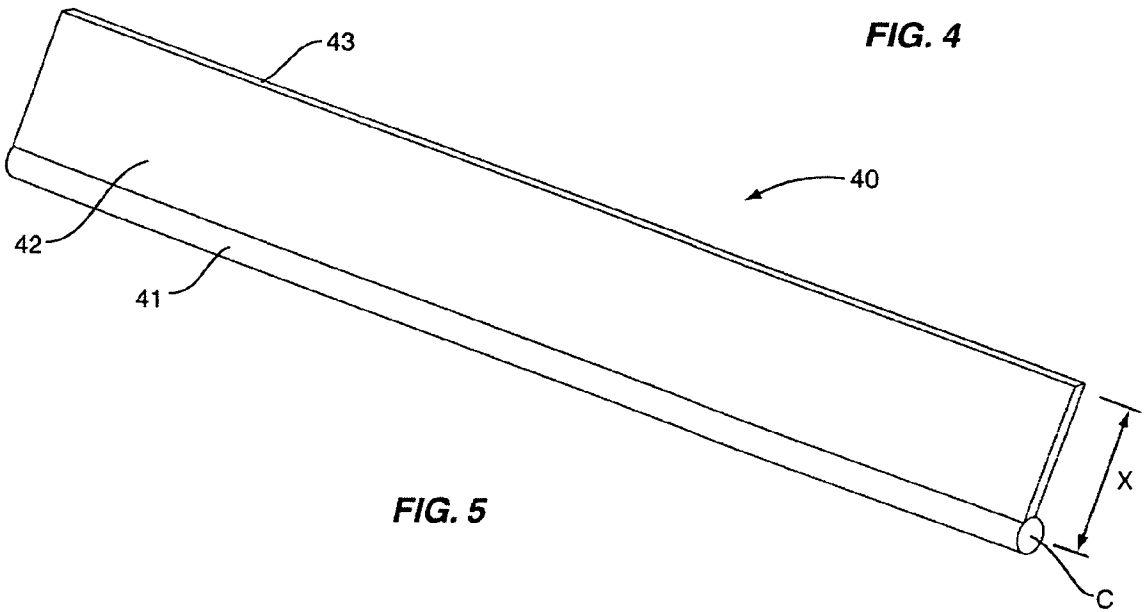
FIG. 5 is a perspective view of an agitating member according to one embodiment.

As illustrated in FIGS. 3 and 5, an agitating member 40 is positioned within the interior space 25 between the blade 23 and the auger 50. The agitating member 40 rotates within the interior space 25 and moves the toner away from the inlet 22 and towards the auger 50. In the embodiment of FIG. 3, the agitating member 40 rotates in direction P. Agitating member 40 includes an elongated shaft 41 that may include a variety of lengths, and may include various sectional shapes including rectangular as illustrated in FIG. 3 and circular as illustrated in FIG. 5. An arm 42 is attached to and extends outward from the shaft 41. Arm 42 may include the same or a different length as the shaft 41. As illustrated in FIG. 5, a distance X is formed between a center C of the shaft 41 and an outer end 43 of the arm 42. Arm 42 may be constructed from various materials. In one embodiment, arm 42 is constructed of a flexible material that deforms during rotation of the agitating member 40. Materials include but are not limited to mylar, plastic, and rubber. In one specific embodiment, arm 42 is mylar that is about 0.125 millimeter thick.

As illustrated in FIG. 3, the auger 50 is positioned within the sweep envelope of the agitating member 40 as a distance between the center C of the shaft 41 and the edge of the auger 50 is less than X. This positioning causes the arm 42 to contact against the auger 50 and deform as it rotates past the auger 50. The deformation causes the arm 42 to direct the toner into the auger 50 where it is then moved laterally and out of the housing 20. Likewise, the blade 23 may be positioned within the sweep envelope of the agitating member 40 causing the arm 42 to contact against the blade 23 and deform as it rotates. This deformation prevents toner from pooling within the inlet 22 and maintains the toner moving towards the auger 50. The agitating member 40 may also be positioned for the arm 42 to contact the floor 27 and/or ceiling 29 during rotation.

In another embodiment, the agitating member 40 is positioned such that it contacts just one of the blade 23 and the auger 50 during the rotation. Stated in another manner, only one of the blade 23 and auger 50 lie within the sweep envelope of the agitating member 40.

Figure 6:
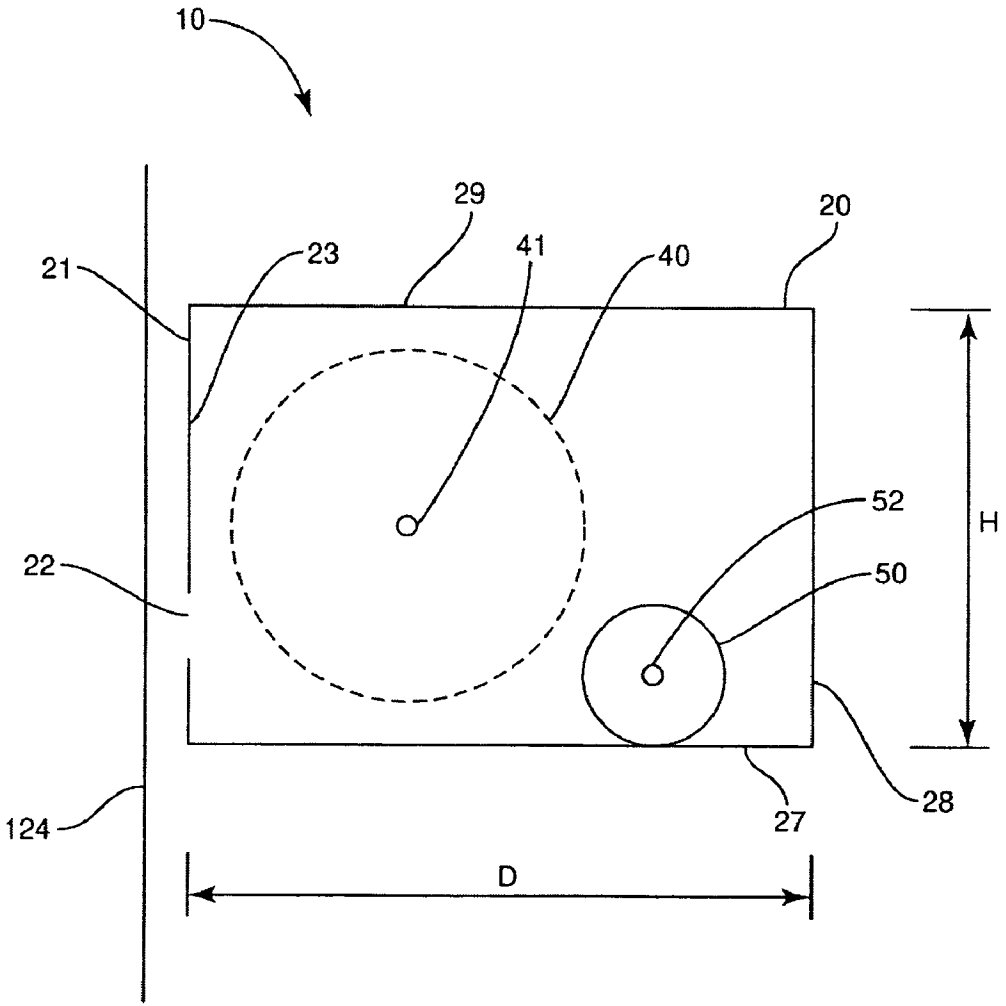
FIG. 6 is a schematic side view of a cleaning device according to one embodiment.

FIG. 6 illustrates a schematic representation of the removal device 10 according to one embodiment. The removal device includes a depth D that extends between the front side 21 and the back side 28 of the housing 20. Device 10 also includes a height H that extends between the floor 27 and the ceiling 29. In one embodiment, the device 10 is positioned in a horizontal orientation with the inlet 22 at the same height H as the auger 50 (i.e., the inlet 22 is at the same height as the sweep envelope of the auger 50). Further, the floor 27 may be substantially horizontal and lie at the same height along the depth of the housing 20. Because of the horizontal orientation and the inlet 22 and the auger 50 at the same height H, the agitating member 40 is necessary to move the toner from the inlet 22 towards the auger 50 as gravity is not a factor to move the toner. The horizontal, orientation may be a result of the device 10 positioned within the image forming apparatus 100 at a point along a vertical section of the ITM belt 124.

In another embodiment as illustrated in FIG. 6, the shaft 41 of the agitating member 40 is positioned at a greater height H than the inlet 22. The shaft 41 may also be positioned at a greater height H than the sweep envelope of the auger 50 as illustrated in the embodiment of FIG. 6, or within the sweep envelope but above a center point 52 of the auger 50 as illustrated in FIG. 3.

As illustrated in FIG. 2, removal device 10 may further include a number of gears on the exterior of the housing 20. In this embodiment, the gears include an agitating member gear 71 connected to the shaft 41 of the agitating member 40. An auger gear 72 is connected to the auger 50. An idler gear 73 may operatively connect the gears 71, 72. The gears transfer a rotational force to rotate the auger 50 and agitating member 40. In one embodiment, the size of the auger gear 72 is smaller than the agitating member gear 71 causing the auger 50 to rotate at a greater speed than the agitating member 40.

Figure 7:
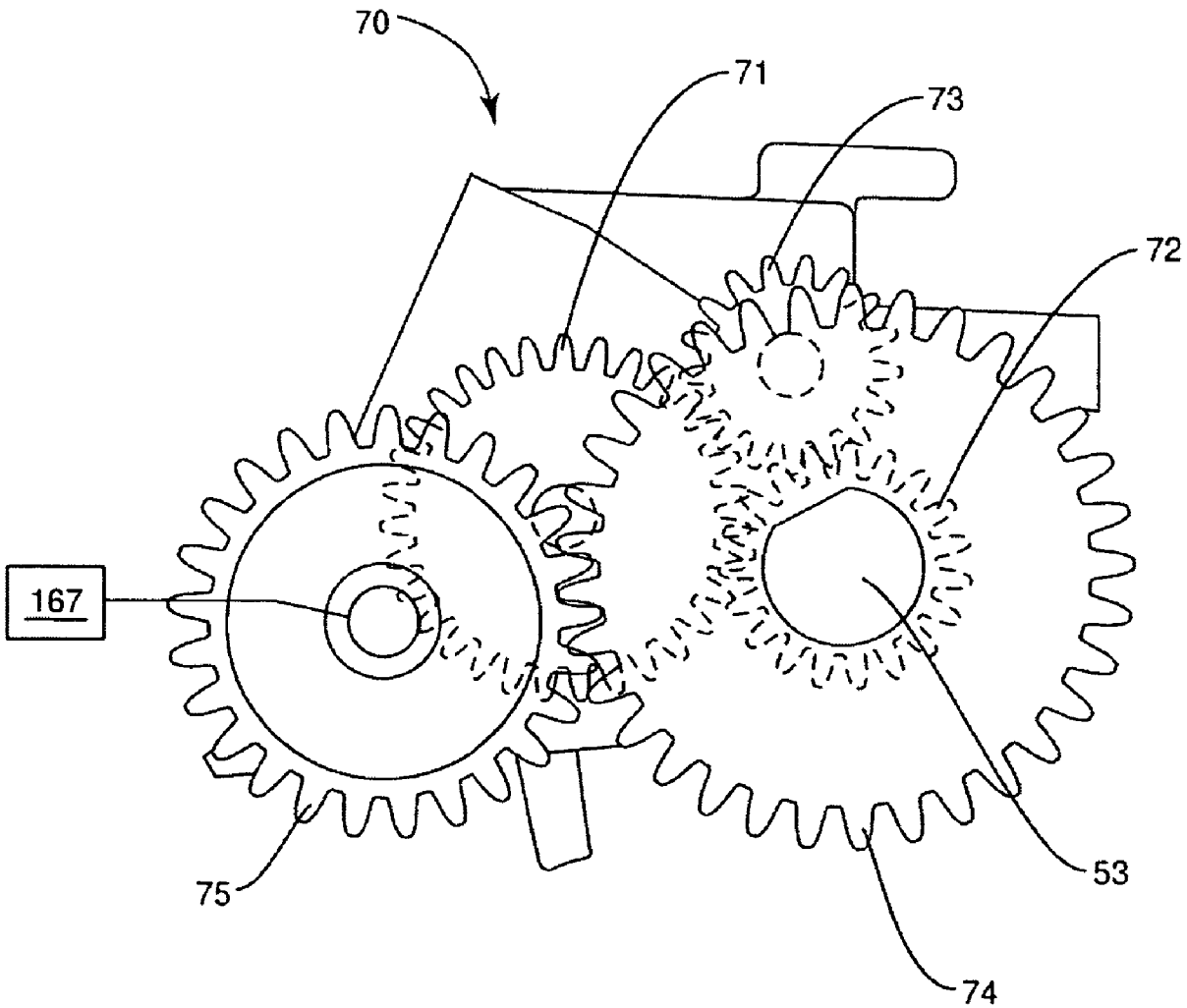
FIG. 7 is a side schematic view of a gear train according to one embodiment.

FIG. 7 illustrates a gear train 70 that provides the rotational force to the agitating member 40 and the auger 50. An idler gear 75 is operatively connected to the motor 167 that rotates the drive roll 141 of the ITM belt 124. Idler gear 75 meshes with a second auger gear 74 that is also positioned on the auger shaft 53. Rotation of second auger gear 74 imparts rotation to the auger shaft 53 which drives gears 72, 73, and 71.

The position of the agitating member 40 within the interior space 25 may vary. In one embodiment as illustrated in FIG. 3, the auger 50 and the blade 23 are each positioned within the sweep envelope of the agitating member 40. In another embodiment, only one of the auger 50 and blade 23 are positioned within the sweep envelope. In another embodiment, neither of the auger 50 or blade 23 are positioned within the sweep envelope. In this embodiment, the arm 42 does not contact either of the auger 50 or blade 23 during rotation. The arm 42 in this embodiment may be constructed out of a flexible material. Alternatively, arm 42 may be constructed from a non-flexible material, including but not limited to Mylar, PET, TPE, ETFE, PI, PAI, and other film materials.

The agitating member 40 may include a single arm 42 as illustrated in the embodiment of FIG. 5. In another embodiment, the agitating member 40 includes multiple arms. Each of the arms may include the same shape and length, or may include different shapes and/or lengths. Further, the arm 42 may include a variety of different shapes and sizes. In one embodiment, an opening is positioned within the arm 42 between the shaft 41 and the outer end 43.

In the embodiment illustrated in FIG. 1, the removal device 10 removes toner from an ITM belt 124. Removal device 10 may also remove toner from other belts. In another embodiment, removal device 10 removes toner from a transport belt used to transport media sheets in a direct transfer apparatus. The toner may be applied to the transport belt for various reasons, such as during color calibration processes, or inadvertently during transport of the media sheets and toner. In another embodiment, the PC drums 114 are formed as belts and the removal device 10 is positioned to remove toner from the surfaces of these belts.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections and the like and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. In one embodiment, the auger 50, agitating member 40, and the blade 23 extend along an entire longitudinal width of the housing 20. The present embodiments are, therefore, to be considered in all respects as illustrative and not restrictive, and all changes coming within the meaning and equivalency range of the appended claims are intended to be embraced therein.

What is claimed is:

1. A device to remove toner from a belt within an image forming apparatus, the device comprising:

a housing including an interior space to contain the toner removed from the belt, the housing including an inlet positioned on a first side of the housing that faces towards the belt and leads into the interior space;

a blade in proximity to the inlet and positioned to remove the toner from the belt and direct the toner into the inlet;

an auger rotationally positioned within the interior space to move the toner along a longitudinal width of the housing, the auger positioned away from the inlet at a second side of the housing; and an agitating member rotationally positioned within the interior space to move the toner that enters into the inlet towards the auger, the agitating member including a shaft and a flexible arm that extends outward from the shaft and contacts against the blade and the auger during rotation.

2. The device of claim 1, wherein the blade includes a front surface that faces towards the belt and a hack surface that faces towards the interior space and an edge positioned between the front and back surfaces that faces towards the inlet, the arm contacting against the back surface during the rotation and moving towards the edge.

3. The device of claim 1, wherein the housing further includes a floor that extends between the first and second sides, the agitating member being positioned with the arm contacting the floor during the rotation.

4. The device of claim 1, wherein the auger and the agitating member are connected by gears with the auger rotating at a higher speed than the agitating member.

5. The device of claim 1, wherein the housing includes a horizontal orientation with the inlet and the auger aligned at a common height.

6. The device of claim 1, wherein the interior space includes a floor at a vertically lower height and a ceiling at a vertically upper height with the inlet being in closer proximity to the floor than to the ceiling.

7. The device of claim 1, wherein a center of the shaft is positioned vertically above a center of the auger and an upper edge of the inlet.

8. The device of claim 1, wherein the agitating member includes a second arm that extends outward from the shaft.

9. A device to remove toner from a belt within an image forming apparatus, the device comprising:

a housing to contain the toner removed from the belt;

a blade including a leading edge that extends outward from the housing to remove the toner from the belt;

an auger rotationally positioned within the housing to move the toner along a longitudinal width of the housing, the auger being spaced away from and at a different depth than the blade; and an agitating member rotationally positioned within the housing between the blade and the auger to move the toner from the blade and towards the auger;

the housing including a horizontal orientation with the leading edge of the blade and a sweep envelope of the auger positioned at a common vertical height.

10. The device of claim 9, wherein at least one of the blade and the auger extending into a sweep envelope of the agitating member.

11. The device of claim 10, wherein both the blade and auger extend into the sweep envelope of the agitating member.

12. The device of claim 9, wherein the agitating member includes a shaft and a flexible arm that is attached to and extends outward from the shaft.

13. The device of claim 12, wherein a center of the shaft is positioned at a vertical height above a center of the auger and the leading edge of the blade.

14. The device of claim 9, wherein the housing further includes an inlet that leads into the interior space, the inlet formed between the leading edge of the blade and a seal that extends upward from a floor of the housing.

15. The device of claim 9, wherein the auger and the agitating member are connected by gears with the auger rotating at a higher speed than the agitating member.

16. The device of claim 9, wherein the auger, the blade, and the agitating member extend along an entire longitudinal width of the housing.

17. A method of removing toner from a belt within an image forming apparatus, the method comprising:

removing the toner from the belt and directing the toner through an inlet and into an interior space of a housing;

rotating an agitating member positioned within the interior space and horizontally moving the toner along a depth of the housing from the inlet towards an auger at a second side of the housing;

deforming the agitating member as the agitating member rotates past and contacts the auger; and rotating the auger and laterally moving the toner along a longitudinal width of the housing.

18. The method of claim 17, further comprising deforming the agitating member as the agitating member rotates past and contacts a blade positioned at the inlet.

19. The method of claim 17, wherein the step of deforming the agitating member as the agitating member rotates past and contacts the auger comprises deforming a flexible arm that extends outward from a shaft of the agitating member.

20. The method of claim 17, further comprising laterally moving the toner along the longitudinal width of the housing and into a storage container associated with the housing.

* * * * *